US007926803B2

(12) United States Patent
Sherman et al.

(10) Patent No.: US 7,926,803 B2
(45) Date of Patent: Apr. 19, 2011

(54) MEDIA DRIVE

(75) Inventors: Raymond C. Sherman, Camas, WA (US); Allan G. Olson, Camas, WA (US); Wesley R. Schalk, Camas, WA (US); Juan D. Ramos, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 488 days.

(21) Appl. No.: 11/669,277

(22) Filed: Jan. 31, 2007

(65) Prior Publication Data

US 2008/0179814 A1 Jul. 31, 2008

(51) Int. Cl.
*B65H 3/06* (2006.01)

(52) U.S. Cl. ..... 271/117

(58) Field of Classification Search ..... 271/117, 271/118, 273; 73/53, 55, 56, 76–79
See application file for complete search history.

(56) References Cited

U.S. PATENT DOCUMENTS

| | | | | |
|---|---|---|---|---|
| 3,514,098 | A * | 5/1970 | Ostwald | 271/110 |
| 3,584,866 | A * | 6/1971 | Ross et al. | 271/12 |
| 4,418,906 | A * | 12/1983 | Scott | 271/99 |
| 4,889,331 | A * | 12/1989 | Sardella | 271/11 |
| 4,896,872 | A * | 1/1990 | Sardella | 271/11 |
| 5,899,450 | A | 5/1999 | Gettelfinger et al. | |
| 6,000,690 | A | 12/1999 | Kudoh | |
| 6,089,563 | A | 7/2000 | Takashimizu et al. | |
| 6,352,256 | B1 | 3/2002 | Hsieh | |
| 6,382,619 | B1 | 5/2002 | Gustafson et al. | |
| 6,457,706 | B1 | 10/2002 | Sheng et al. | |
| 6,467,765 | B2 | 10/2002 | Yukimachi | |
| 6,651,972 | B2 * | 11/2003 | Hsiao et al. | 271/114 |
| 6,824,130 | B1 * | 11/2004 | Sardella et al. | 271/112 |
| 6,857,630 | B2 | 2/2005 | Yu | |
| 7,594,651 | B2 * | 9/2009 | Hall et al. | 271/117 |
| 2006/0071395 | A1 * | 4/2006 | Mizuno | 271/90 |

* cited by examiner

*Primary Examiner* — Stefanos Karmis
*Assistant Examiner* — Michael C McCullough

(57) ABSTRACT

Various media drive and methods move a media drive member relative to a medium.

18 Claims, 11 Drawing Sheets

MEDIA DRIVE

CROSS-REFERENCE TO RELATED PATENT APPLICATIONS

The present application is related to co-pending U.S. patent application Ser. No. 11/669930 filed on the same day herewith by Wesley R. Schalk and Allan G. Olson and entitled SEPARATION SYSTEM, the full disclosure of which is hereby incorporated by reference.

BACKGROUND

Various devices, such as printers, copiers, scanners and the like sometimes utilize a pick tire to drive media. Such devices move the pick tire into and out of engagement with the media using complex mechanisms that are subject to drag. In addition, such mechanisms may cause the pick tire to induce stack irregularities, causing picking, jamming and skew issues.

DETAILED DESCRIPTION OF THE EXAMPLE EMBODIMENTS

Figure 1:
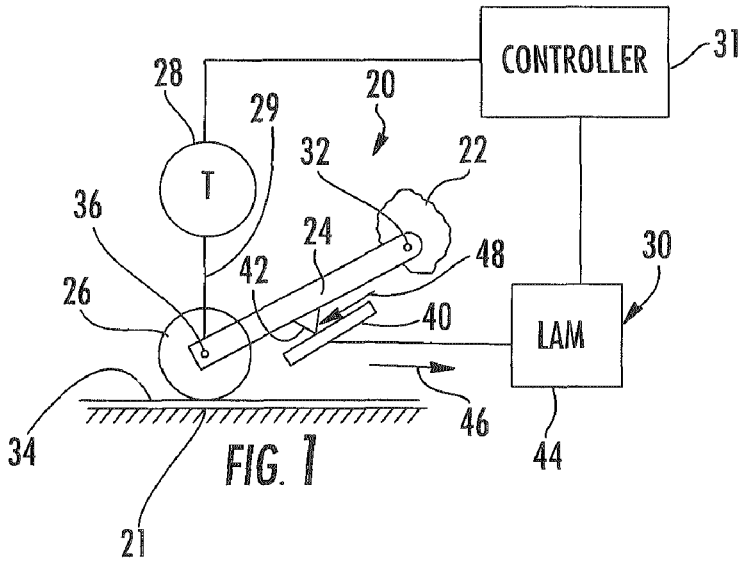
FIG. 1 is a schematic illustration of a media drive system in a media engaging state according to an example embodiment.
Figure 2:
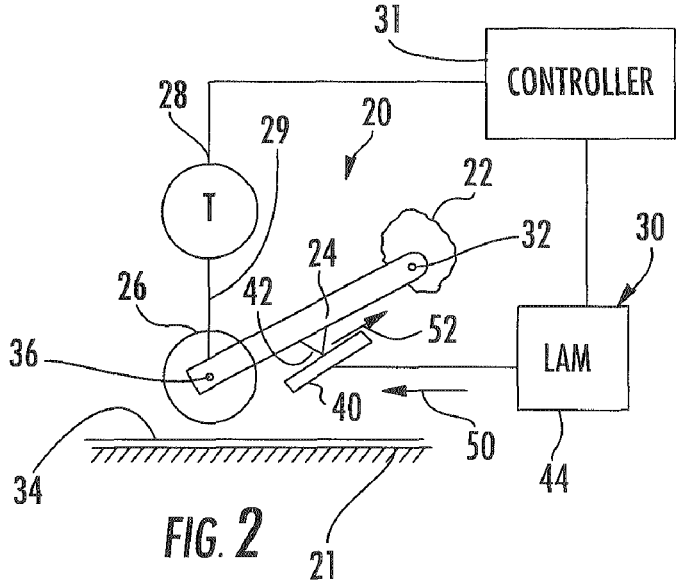
FIG. 2 is a schematic illustration of the media drive system of FIG. 1 in a media disengaged state according to an example embodiment.

FIGS. 1 and 2 schematically illustrate media drive system 20 according to an example embodiment. Media drive system 20 is configured to be actuated between a media driving and engaged or engaging state without experiencing substantial drag and a media disengaged state. FIG. 1 illustrates system 20 in a media driving and engaging state while FIG. 2 illustrates system 20 in a media disengaged state.

As shown by FIGS. 1 and 2, media drive system 20 includes media support 21, drive support 22, arm 24, drive member 26, torque source 28, power train 29 and lift mechanism 30. Media support 21 comprises a surface generally opposite to media drive member 26 when media drive member 26 is in the media engaging and driving state. Media support 21 cooperates with media drive member 26 to sandwich one or more sheets of media therebetween and to facilitate movement of media by media drive member 26. In one embodiment, media support 21 may comprise a substantially flat or planar surface against which one or more sheets 34 of media rest. For example, in one embodiment, media support 21 may comprise the lower surface of a tray, bin or other structure which stores and holds one or more sheets of media for being picked by media drive member 26. Although media support 21 illustrated in a horizontal orientation, in other embodiments, media support 21 may be vertical or maybe inclined or sloped. In still other embodiments, media support 21 may comprise one or more rollers or belts which provide surfaces opposite to media drive member 26.

Drive support 22 comprises one or more structures configured to pivotally support arm 24 for pivotal movement about axis 32. In one embodiment, support 22 comprises a housing or frame which is substantially stationary. In other embodiments, support 22 may have other configurations.

Arm 24 comprises elongate structure having a first end portion pivotally connected to support 22 and a second end portion rotationally supporting media drive member 26 about one or more axes. Arm 24 pivotably supports media drive member 26 for movement between a media engaging and driving position (shown in FIG. 1) and a media disengaged position (shown in FIG. 2). In the media engaging and driving position, media drive member 26 is in frictional contact with a sheet of media 34 and cooperates with media support 21 to drive or urge the sheet of media 34. In the media disengaged position, media drive member 26 is spaced from and out of contact with sheet 34 as shown in FIG. 2.

Media drive member 26 comprises one or more structures or members configured to be rotationally driven about one or more axes while in contact with sheet 34 to move sheet 34. In one embodiment, media drive member 26 comprises one or more rollers. In another embodiment, media drive member 26 may comprise a belt or other media gripping surfaces which are driven or rotated about multiple axes. In one embodiment, media drive member 26 comprises a pick tire which is rotatable about axis 36 to facilitate separation and picking of a single sheet of media from a stack of media resting upon media support 21.

Torque source 28 comprises a source of torque for rotationally driving media drive member 26 about the one or more axes. According to one example embodiment, torque source 28 comprises a motor operably coupled to media drive member 26 by a power train 29. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

Power train 29 comprises a drive train or transmission by which torque from torque source 28 is transmitted to media drive member 26 to rotate media drive member 26. Power train 29 may comprise a gear train, a chain and sprocket arrangement, a belt and pulley arrangement or combinations thereof. Although torque source 28 is illustrated as being solely connected to drive member 26, torque source 28 may additionally provide torque for other devices, components or mechanisms via other power trains.

Lift mechanism 30 comprises a mechanism configured to selectively move media drive member 26 between the media driving and engaging state and the media disengaged state. Lift mechanism 30 includes cam 40, cam follower 42 and linear actuation mechanism 44. Cam 40 and cam follower 42 are configured such that linear movement of one of cam 40 and cam follower 42 relative to and against the other of cam 40 and cam follower 42 results in arm 24 being lifted and pivoted about axis 32. In the example illustrated, cam follower 42 is coupled to arm 24 while cam 40 is operably connected to linear actuation mechanism 44. In other embodiments, this relationship may be reversed. Although cam 40 is illustrated as a linear ramp, in other embodiments, cam 40 may have other non-linear configurations or profiles such that media drive member 26 is raised in a non-linear fashion in response to linear translation of cam 40.

Linear actuation mechanism 44 comprises a mechanism configured to linearly move one of cam 40 and cam follower 42 against the other of cam 40 and cam follower 42. In the particular example illustrated, linear actuation mechanism 44 linearly moves cam 40. Examples of linear actuation mechanism 44 include linear actuators such as hydraulic-cylinder assemblies, pneumatic-cylinder assemblies and solenoids. Further examples of linear actuation mechanism 44 include rotary actuators, such as motors, and mechanical arrangements for converting rotational motion to linear motion. Examples of such mechanical arrangements include a rack and pinion arrangement, a belt and pulley arrangement, wherein the cam or cam follower is attached to a belt and linear movement occurs between two spaced pulleys supporting the belt, and a chain and sprocket arrangement, wherein linear movement of the cam or cam follower coupled to the chain occurs between two spaced sprockets. In such an embodiment, the rotary actuator may comprise torque source 28 or may comprise an additional torque source or motor.

Controller 31 comprises one or more processing units configured to generate control signals controlling at least torque source 28 and linear actuation mechanism 30. For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 31 may be embodied as part of one or more application-specific integrated circuits (ASICs). Unless otherwise specifically noted, the controller is not limited to any specific combination of hardware circuitry and software, nor to any particular source for the instructions executed by the processing unit.

In operation, when a sheet of media 34 is to be interacted upon, such as by being printed upon, scanned, folded, collated, stapled, cut, or otherwise manipulated, controller 31, following instructions contained in a computer readable medium, generates control signals causing linear actuation mechanism 30 to linearly move cam 40 in the direction indicated by arrow 46 in FIG. 1. As a result, cam follower 42 slides or moves along cam 40 in the direction indicated by arrow 48, causing arm 24 to pivot about axis 32 until media drive member 26 is moved into engagement with the sheet 34. Controller 31 further generates control signals directing torque source 28 to supply torque to media drive member 26 such that sheet 34 is moved for further interaction.

As shown in FIG. 2, when media drive member 26 is to be moved to the disengaged position, such as when new sheets 34 of media are to be loaded or moved upon media support 21, controller 31 generates control signals causing linear actuation mechanism 44 to linearly translate or move cam 40 in a direction indicated by arrow 50. As a result, cam follower 42 slides up cam 40 in the direction indicated by arrow 52, causing arm 24 to pivot in a clockwise direction (as seen in FIG. 2) about axis 32 so as to raise, lift or otherwise move media drive member 26 away from sheet 34 and away from media support 21. During such disengagement of media drive member 26, controller 31 may generate control signals directing torque source 28 to cease or change the supply of torque to media drive member 26. In other embodiments, torque source 28 may continue to deliver torque to media drive member 26.

Overall, media drive system 20 may drive or move media as desired and may be actuated between a media engaging and driving state (shown in FIG. 1) and a media disengaged state (shown in FIG. 2) with a reduced drag being imposed upon system 20. In other words, media drive member 26 may be moved by lift mechanism 30 without substantial friction being imposed upon media drive member 26 in the media driving and engaging state shown in FIG. 1. As a result, torque source 28 may have a reduced size and may consume less power. In addition, the complexity of system 20 may be reduced.

Figure 3:
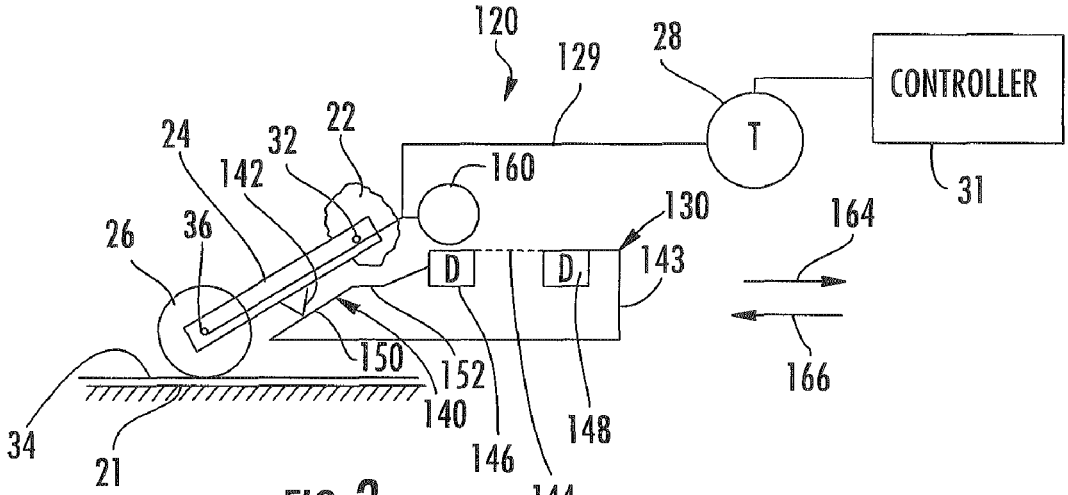
FIG. 3 is a schematic illustration of another embodiment of the media drive system of FIG. 1 in a media engaging state according to an example embodiment.

FIG. 3 schematically illustrates media drive system 120, another embodiment of media drive system 20. Like media drive system 20, media drive system 120 is configured to drive media, such as sheets of media, while in a media driving and engaging state and is configured to be selectively disengaged from the media. As will be described in more detail hereafter, media drive system 120 is further configured to be actuated to at least one disengaged or idling state while engaging and driving media or when fully disengaged from the media.

Media drive system 120 is similar to media drive system 20 except that media drive system 120 includes power train 129 in lieu of power train 29 and includes lift mechanism 130 in lieu of lift mechanism 30. Those remaining elements of media drive system through 120 which correspond to elements of media drive system 20 are numbered similarly. Power train 129 transmits torque from torque source 28 to drive member 26. As schematically illustrated by FIG. 3, power train 129 includes a gear 160. Gear 160 comprises part of a drive train for transmitting torque to drive member 26. In one embodiment, gear 160 may be part of a gear train, serving as power train 129, extending between torque source 28 and drive member 26. In other embodiments, gear 160 may be provided as part of a drive train which includes a chain and sprocket arrangement or a belt and pulley arrangement as well. As will be described hereafter, in addition to transmitting torque to drive member 26, gear 160 also serves as part of lift mechanism 130.

Lift mechanism 130 comprises a mechanism configured to selectively move media drive member 26 between a media driving and engaging position or state in which media drive member 26 is in contact with sheet 34 against support 21 as shown in FIG. 3 and a disengaged position or state. In the example illustrated, lift mechanism 130 utilizes power or torque from torque source 28, the same torque source utilized to drive media drive member 26. As a result, media drive system 120 is less complex. In the example illustrated, lift mechanism 130 utilizes gear 160, a part of power train 129, further reducing the complexity and space consumption of media drive system 120.

Lift mechanism 130 includes cam 140, cam follower 142, rack 143, rack gear 144 and disengagement mechanisms 146, 148. Cam 140 and cam follower 142 are configured to cooperate with one another such that linear movement or translation of one of cam 140 and follower 142 with respect to the other of cam 140 and follower 142 results in arm 24 being pivoted about axis 32. In the particular example illustrated, cam 140 is coupled to rack 143 and is configured to be moved against cam follower 142 which is coupled to arm 24. In other embodiments, this relationship may be reversed.

As further shown by FIG. 3, cam 140 includes a ramp surface 150 and a plateau 152. Ramp surface 150 is an inclined or sloped surface such that movement of cam follower 142 along surface 150 pivot arm 24 about axis 32. Plateau 152 is a generally flat or level surface parallel to rack gear 144. As a result, when cam follow 142 is against plateau 152, further movement of cam 140 does not result in further pivoting of arm 24. As a result, plateau 152 provides a set or predetermined pivotal stop or point for arm 24 which is less sensitive to imprecise positioning of cam 140. In other embodiments, cam 140 may have other configurations.

Rack 143 comprises a structure supporting cam 140, rack 144 and disengagement mechanisms 146 and 148. Rack 143 serves as a carriage or other structure which is movably supported by support 22 or another frame or housing structure for movement relative to axis 32 of arm 24. In one embodiment, rack 143 slides along channels or tracks (not shown) provided by support 22 to guide movement of rack 143 relative to support 22. In other embodiments, rack 143 may have other configurations.

Rack gear 144 extends along and is supported by rack 143 opposite to gear 160. Rack gear 144 has a length sufficient such that rack 143 and cam 140 may be linearly moved a sufficient distance to move or pivot media drive member 26 between the media engaging state and the media disengaged state. When gear 160 is in engagement with rack gear 144, rotation of gear 160 linearly moves rack 143. As a result, pinion gear 160 and rack gear 144 cooperate to serve as a linear actuation mechanism utilizing torque from torque source 28 to linearly move cam 140. In other embodiments, rack gear 144 may be engaged and driven by a gear distinct from gear 160 which receives torque from torque supply 28 or from another torque source.

Disengagement mechanism 146 comprises a mechanism configured to disengage gear 160 from rack 144 in response to gear 160 rotating in a first direction. Disengagement mechanism 146 is further configured to engage gear 160 with rack gear 144 in response to gear 160 rotating in a second direction. In the particular example illustrated, disengagement mechanism 146 is configured to disengage gear 160 from rack gear 144 when gear 160 is rotating in a counter-clockwise direction as seen in FIG. 3. Disengagement mechanism to 146 is configured to engage gear 160 with rack gear 144 when gear 160 is rotating in a clockwise direction as seen in FIG. 3. Because disengagement mechanism 146 disengages gear 160 from rack gear 144 when gear 160 is rotating in a first direction and when gear 160 is in engagement with disengagement mechanism 146 at one end of rack gear 144, gear 160 may continue to rotate so as to continue to transmit torque to media drive member 26 without further movement of rack 143 and cam 140. In other words, media drive member 26 may continue to drive a sheet of media in the media driving state while arm 24 is stationary.

According to one embodiment, disengagement mechanism 146 may comprise a gear rotationally supported by rack 143 by a one-way clutch (not shown). In yet another embodiment, as illustrated with respect to media drive system 220 hereafter, disengagement mechanism 146 may comprise a gear having a rotatable axle that slides within an elongate slot between a freely rotating or idling position and a locked position in which the gear engages a catch inhibiting further rotation of the gear. This latter embodiment disengages gear 160 from rack gear 144 and permits gear 160 to continue to rotate with substantially little noise and with substantially little friction or drag. In other embodiments, disengagement mechanism 146 may have other configurations.

Disengagement mechanism 148 is substantially similar to disengagement mechanism 146 but is alternatively configured to disengage gear 160 from rack gear 144 in response to gear 160 rotating in the second direction. Disengagement mechanism 146 is further configured to engage gear 160 with rack gear 144 in response to gear 160 rotating in the first direction. In the particular example illustrated, disengagement mechanism 146 is configured to disengage gear 160 from rack gear 144 when gear 160 is rotating in a clockwise direction as seen in FIG. 3. Disengagement mechanism 146 is configured to engage gear 160 with rack gear 144 when gear 160 is rotating in a counter-clockwise direction as seen in FIG. 3. As a result, torque source 28 may continue to drive gear 160 without further movement of rack 143 and cam 140 or further movement of arm 24 when media drive member 26 has been sufficiently moved to the disengaged state when rack 143 has reached its travel limit.

Although lift mechanism 130 is illustrated as including a disengagement mechanism on each end of rack gear 144, defining the two limits of travel for rack 143, in other embodiments, one or both of disengagement mechanisms 146 and 148 may be omitted. For example, in one embodiment, disengagement mechanism 148 may be omitted, wherein additional sensors may be provided to identify when rack 143 as reached its travel limit and wherein controller 31 generates control signals directing torque source 28 to cease transmission of torque to gear 160. In another embodiment, disengagement mechanism 148 may also or alternatively be omitted, wherein a pinion gear distinct from gear 160 is utilized to move rack 143, wherein sensors are provided to identify when rack 143 has reached its travel limit, and wherein controller 31 generates control signals causing the supply of torque to the distinct pinion gear to be terminated in response to signals from the sensors.

In operation, controller 31, following instructions contained in a computer-readable medium, generates control signals directing torque source 28 to provide torque in either a first direction or a second direction. When torque source 28 applies torque in a first direction, gear 160 rotates in a counter-clockwise direction as seen in FIG. 3. When gear 160 is rotating in the counter-clockwise direction and is in an engagement with disengagement mechanism 148, disengagement mechanism 148 does not rotate. As a result, rack 143 and cam 140 will be driven to the right as indicated by arrow 164 to move cam follower 142 towards a media engaging state shown in FIG. 3. When gear 160 is rotating in the counter-clockwise direction and is in engagement with rack gear 144, rack 143 is driven further to the right as indicated by arrow 164 to move media drive member 26 further towards the media engaging state shown in FIG. 3. When gear 160 is rotating in the counter-clockwise direction and is in engagement with disengagement mechanism 146, gear 160 is disengaged from rack gear 144 and further movement of rack 143 is ceased. Rotation of gear 160 in the counter-clockwise direction further result in torque being transmitted to drive member 26 such that drive member 26 also rotates to move sheet 34 relative to support 21.

When torque source 28 applies torque in a second direction, gear 160 rotates in a clockwise direction as seen in FIG. 3. When gear 160 is rotating in the clockwise direction and is in and engagement with disengagement mechanism 146, disengagement mechanism 146 does not rotate. As a result, rack 143 and cam 140 will be driven to the left as indicated by arrow 166 to move cam follower 142 towards a media disengaging state in which media drive member 26 is removed from or out of contact with media sheet 34. When gear 160 is rotating in the clockwise direction and is in engagement with rack gear 144, rack 143 is driven further to the left as indicated by arrow 166 to move media drive member 26 further towards the media disengaging state shown in FIG. 3. When gear 160 is rotating in the clockwise direction and is in engagement with disengagement mechanism 148, gear 160 is disengaged from rack gear 144 and further movement of rack 143 is ceased.

FIGS. 4-14 illustrate media drive system 220, another embodiment of media drive system 20. Media drive system 220 is configured to drive or move sheets or other configurations of media prior to or after the media has been interacted upon such as by being printed upon, scanned, collated, stapled or folded. In the particular example illustrated, media drive system 220 is configured to pick a sheet of media from a tray, bin or other storage device. As with media drive system 20, media drive system 220 linearly moves a cam and a cam follower relative to one another to pivot and move a media drive member towards and away from a medium. As with media drive system 120, media drive system 220 includes a rack and pinion arrangement for linearly moving a cam. As with media drive system 120, media drive system 220 utilizes torque from a single torque source to drive a media drive member as well as to linearly move the cam. Like media drive system 120, media drive system 220 additionally includes disengagement mechanisms permit continued transmission of torque to the media drive member without further movement of the cam.

As shown by FIGS. 4-7, media drive system 220 includes media support 21 (shown and described with respect to FIG. 1), drive support 222, arm 224, media drive members 226, torque source 28 (shown and described with respect to FIG. 1), lift mechanism 230, media stop mechanism 231 and controller 31. Drive support 222 comprises one or more structures configured to slidably supports portions of lift mechanism 230. In one embodiment, support 222 comprises a bar which is stationarily supported by a housing or frame (not shown) of the device in which media drive system 220 is provided. In other embodiments, support 222 may have other configurations. For example, in other embodiments, separate structures or different configurations may be utilized to slidably support portions of lift mechanism 230.

Arm 224 comprises one or more structures having a first end portion pivotally coupled to support 222 and a second end portion rotationally supporting media drive members 226 about one or more axes. In the example embodiment illustrated, arm 224 is pivotally supported by a shaft 302 of power train 229. In other embodiments, arm 224 may be pivotally connected to support 222 directly or may be pivotally supported by other structures. Arm 224 pivotally supports media drive member 226 for movement between a media engaging and driving position or state (shown in FIGS. 4-7) and a media disengaged position or state (shown in FIGS. 10-13). In the media engaging and driving position, media drive member 226 is in frictional contact with a sheet of media 34 and cooperates with media support 21 to drive or urge the sheet of media 34. In the media disengaged position, media drive member 226 is spaced from and out of contact with sheet 34 as shown in FIGS. 10-13. As further shown by FIG. 4, arm 224 also supports portions of power train 229. In other embodiments, other structures may be used to support power train 229.

Media drive member 226 comprises one or more structures or members configured to be rotationally driven while in contact with sheet 34 to move sheet 34. In the example illustrated, media drive member 226 comprises a pair of rollers. In the example shown, media drive member 226 comprises pick tires which are rotatable about axis 236 (shown in FIG. 5) to facilitate separation or picking of a single sheet of media from a stack of media resting upon media support 21. In another embodiment, media drive member 226 may comprise greater or fewer than two such rollers or tires. In yet other embodiments, media drive member 226 may comprise a belt or other media gripping surface which is driven or rotated about multiple axes.

Figure 4:
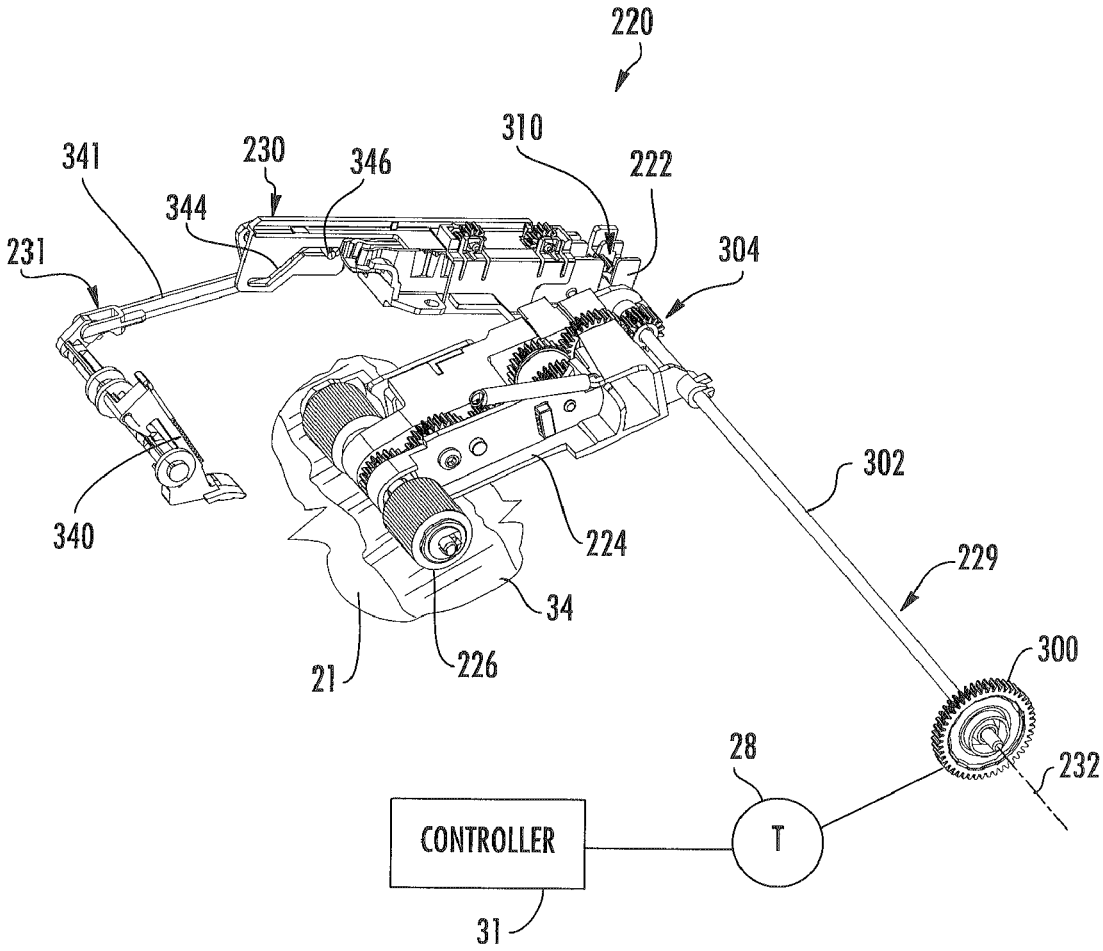
FIG. 4 is a top perspective view of another embodiment of the media drive system of FIG. 1 in a media engaging state according to an example embodiment.

Power train 229 transmits torque from torque source 28 to media drive member 226 and to lift mechanism 230. Power train 229 is operably coupled to an output shaft of torque source 28 and is further operably coupled to media drive member 226 and lift mechanism 230. As shown by FIG. 4, power train 229 includes gear 300, shaft 302, gear train 304 and gear train 310. Gear 300 is operably coupled to an output shaft of torque source 28 and is fixedly secured to shaft 302. Shaft 302 is fixedly secured to gear trains 304 and 310. As noted above, shaft 302 further pivotally supports arm 224 and is pivotally supported by support 222 at one end. Gear train 304 comprises a series of gears extending from shaft 302 to drive members 226. Torque transmitted via gear train 304, drives media drive member 226.

Figure 7:
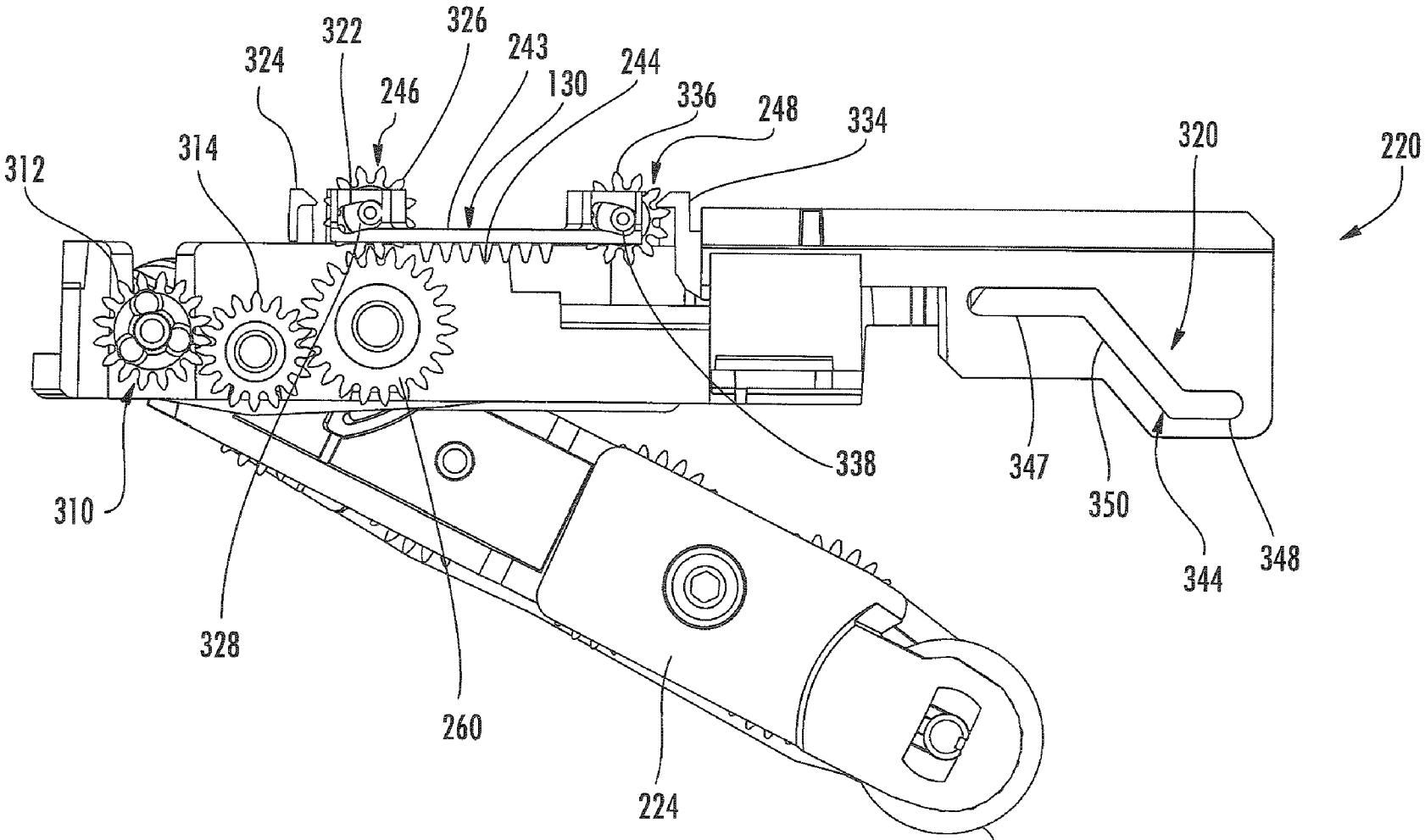
FIG. 7 is a sectional view of the media drive system of FIG. 4 taken along line 7-7 in FIG. 6 according to an example embodiment.

As shown by FIG. 7, a section view through support 222, gear train 310 comprises a series of gears including a first gear 312 affixed to shaft 302, one or more intermediate gears 314 and a terminal gear 260. As will be described in more detail hereafter, terminal gear 260 serves as a pinion gear in lift mechanism 230. Gear train 310 transmits torque to gear 260 to selectively reposition arm 224 and media drive member 226 with respect to media support 21 and sheet 34 (shown in FIG. 4). In other embodiments, power train 229 may include other torque transmitting arrangements. For example, in other embodiments, power train 229 may include other gear train configurations, a chain and sprocket arrangement, a belt and pulley arrangement, or combinations thereof.

Lift mechanism 230 comprises a mechanism configured to selectively move media drive member 226 towards or away from media support 21 and sheet 34. In the example illustrated, lift mechanism 230 is configured to selectively pivot arm 224 so as to move media drive member 226 relative to media. In the particular example illustrated, media lift mechanism 230 is further configured to selectively move media stop mechanism 231 between a first position across a media path and a second position withdrawn from the media path. In other embodiments, this additional feature of lift mechanism 230 may be omitted.

Figure 8:
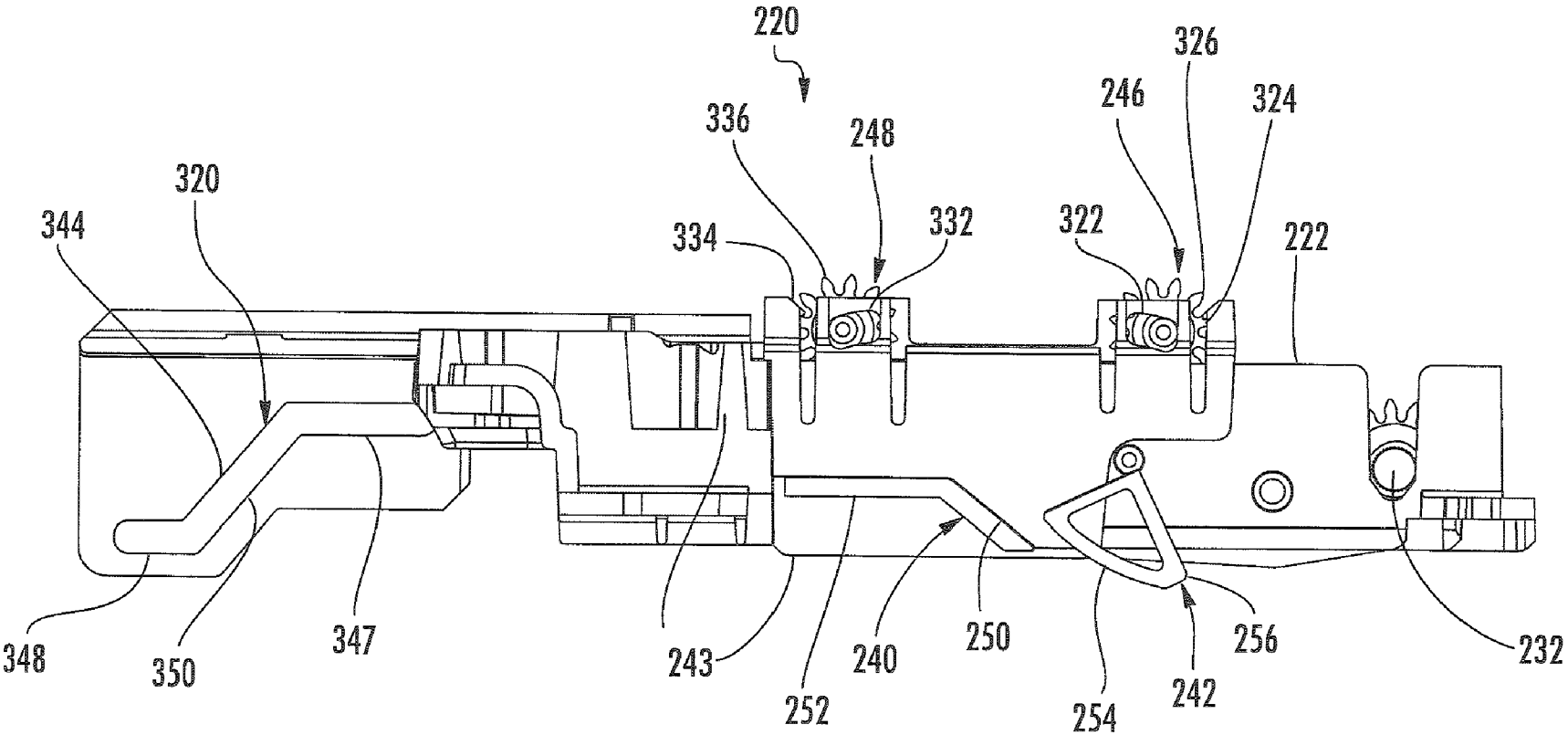
FIG. 8 is a sectional view of the media drive system of FIG. 4 taken along line 8-8 of FIG. 6 according to an example embodiment.

As shown by FIGS. 7 and 8, media lift mechanism 230 includes cam 240, cam follower 242, rack 243, rack gear 244, disengagement mechanisms 246, 248 and media stop lift 320. Cam 240 comprises a collection of surfaces configured to be linearly moved or translated against cam follower 242 which result in control the movement of cam follower 242 and arm 224. As shown in FIG. 8, cam 240 extends from rack 243 and includes a ramp surface 250 and a plateau 252. Ramp surface 250 is an inclined or sloped surface against which cam follower 242 slides up surface 250 when rack 243 is being linearly moved to the right (as seen in FIG. 8) so as to pivot arm 224 in a clockwise direction (as seen in FIG. 8) about axis 232 away from media support 21 (shown in FIG. 4). When rack 243 is being moved to the left, cam follower 242 slides down surface 250 to pivot arm 224 in a counter-clockwise direction (as seen in FIG. 8) about axis 232 towards media support 21.

Plateau 252 is a substantially flat or planar surface extending substantially parallel to the direction in which rack 243 linearly translates. Plateau 252 provides a surface against which cam follower 242 rests when arm 224 is in a fully raised position. As a result, when cam follower 242 is against plateau 252, further movement of cam 240 does not result in further pivoting of arm 224. As a result, plateau 252 provides a set or predetermined pivotal stop or point for arm 224 which is less sensitive to imprecise positioning of cam 240. In other embodiments, cam 240 may have other configurations.

Figure 5:
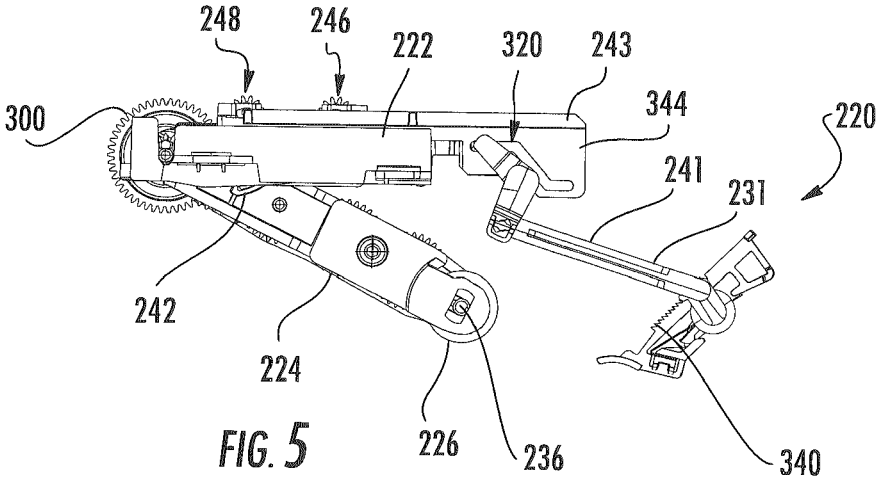
FIG. 5 is a side elevation of view of the media drive system of FIG. 4 according to an example embodiment.
Figure 6:
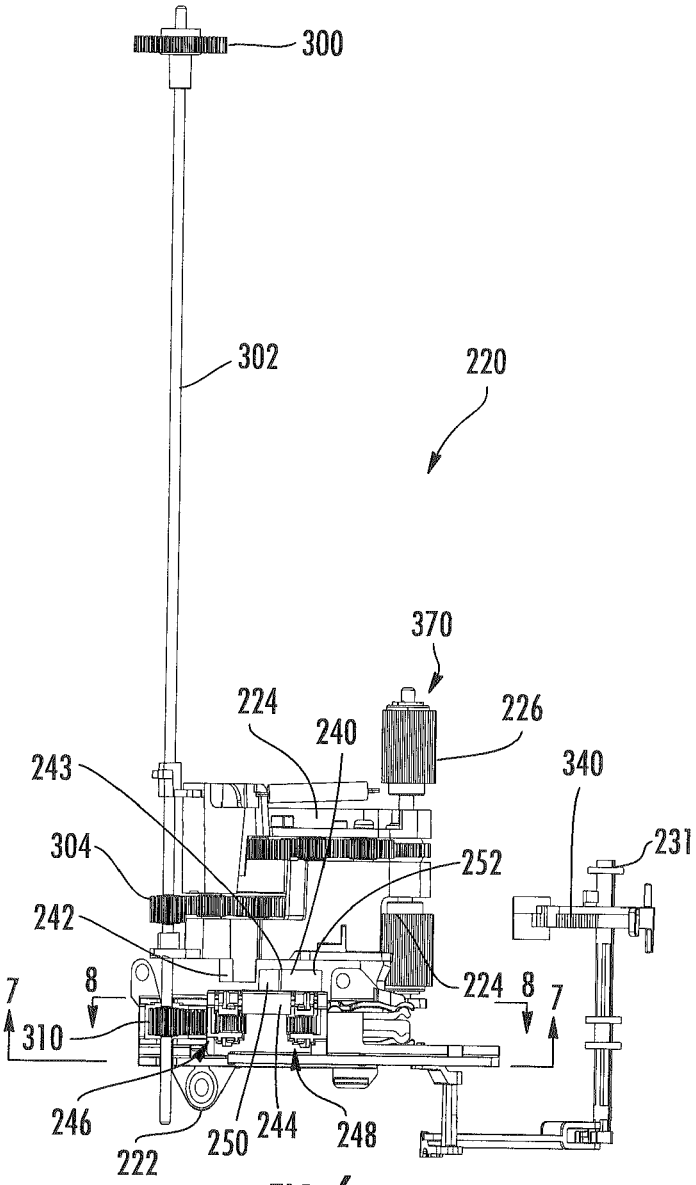
FIG. 6 is a top plan view of the media drive system of FIG. 4 according to an example embodiment.

Cam follower 242 comprises a structure coupled to arm 224 so as to move with arm 224 and so as to engage and follow cam 240. FIG. 5 illustrates cam follower 242 extending from arm 224. As shown in FIG. 8, cam follower 242 includes an arcuate surface 254 and a toe 256. Surface 254 is arcuate so as to facilitate sliding and pivoting of arm 224 as cam 240 is moved against cam follower 242. Toe 256 is a substantially flat end or tip configured to more stably rest upon plateau 252 when arm 224 has been pivoted to the fully raised position or media disengaging state. In other embodiments, cam follower 242 may have other configurations.

Rack 243 comprises a structure configured to linearly slide along support 222 while carrying cam 240, rack gear 244 and disengagement mechanisms 246 and 248. As will be described in more detail hereafter, rack 243 further carries a cam 344 associated with media stop lift 320. In other embodiments, rack 243 may have other configurations and may be slidably supported for linear movement by other structures.

As shown by FIG. 7, rack gear 244 extends from rack 243 across from or opposite to gear 260. Rack gear 244 cooperates with gear 260 to linearly move rack gear 244 in response to rotation of gear 260 when gear 260 is in meshing engagement with rack gear 244. Rack gear 244 has a sufficient length to translate cam 240 a sufficient distance so as to pivot arm 224 and media drive member 226 between the fully lowered and the fully raised positions.

Disengagement mechanisms 246 and 248 are located at opposite ends of rack gear 244 and comprise mechanisms configured to selectively disengage gear 260 from rack gear 244 depending upon the direction in which gear 260 is being rotationally driven. Disengagement mechanism 246 is configured to disengage gear 260 when gear 260 is engaging disengagement mechanism 246 and is rotating in a clockwise direction as seen in FIG. 7. Disengagement mechanisms 246 is further configured to engage gear 260 with rack gear 244 in response to gear 260 rotating in a second direction while in engagement with disengagement mechanism 246. Because disengagement mechanism 246 disengages gear 260 from rack gear 244 when gear 260 is rotating in a first direction and when gear 260 is in engagement with disengagement mechanism 246 at one end of rack gear 244, gear 260 may continue to rotate so as to continue to transmit torque to media drive member 226 without further movement of rack 243 and cam 240. In other words, media drive member 226 may continue to drive a sheet of media in the media driving state while arm 224 is stationary.

In the example embodiment illustrated, disengagement mechanism 246 includes slot 322, catch 324 and lost motion element 326. Slot 322 comprises an elongate channel configured to guide sliding translation as well as rotation of lost motion element 326. Slot 322 is coupled to and carried by rack 243 and is configured to facilitate movement of lost motion element 326 between a first position (shown in FIG. 7) in which the lost motion element 326 freely rotates within slot 322 at one end of slot 322 and a second position (shown in FIG. 10) in which lost motion element 326 engages catch 324 such that rotation of element 326 is inhibited. In other embodiments, slot 322 may comprise other guiding mechanisms or structures.

Catch 324 comprises one or more structures couple to and carried by rack 243 and configured to engage lost motion element 326 so as to inhibit or stop rotation of lost motion element 326. In the embodiment illustrated, catch 324 comprises a hook-like structure configured to engage teeth of lost motion element 326. In other embodiments, catch 324 may comprise other structures or may alternatively or additionally be formed from a material having a high coefficient of friction with lost motion element 326 so as to inhibit relative rotation of lost motion element 326.

Lost motion element 326 comprises a structure configured to be rotated when in engagement with gear 260, to slide within slot 322 between a substantially freely rotating position and a caught or locked position, and to catch or engage catch 324. In the example embodiment, lost motion element 326 comprises a gear having an axle 328 slidably and rotationally received within slot 322. In other embodiments, lost motion element 326 may comprise other lost motion elements. For purposes of this disclosure, the term "lost motion element" is any structure or combination of structures configured to be moved, rotationally or linearly, without transferring motion to an adjacent structure and with insubstantial drag or frictional resistance.

Disengagement mechanism 248 is substantially similar to disengagement mechanism 246 but is alternatively configured to disengage gear 260 from rack gear 244 in response to gear 260 in engagement with disengagement mechanism 248 and when gear 260 rotating in a counter-clockwise direction as seen in FIG. 7. Disengagement mechanism 248 is further configured to engage gear 260 with rack gear 244 in response to gear 260 rotating in a clockwise direction with as seen in FIG. 7 and while in engagement with disengagement mechanism 248. As a result, torque source 28 may continue to drive gear 160 without further movement of rack 243 and cam 240 or further movement of arm 224 when media drive member 226 has been sufficiently moved to the disengaged state and when rack 243 has reached its travel limit.

In the particular example illustrated, disengagement mechanism 248 is similar to disengagement mechanism 246. Disengagement mechanism 248 includes slot 332, catch 334 and lost motion element 336. Slot 332, catch 334 and lost motion element are each substantially identical to slot 322, catch 324 and lost motion element 326, respectively, except that catch 324 is on an opposite side of slot 322 and faces in an opposite direction as compared to catch 324. Like disengagement mechanism 246, disengagement mechanism 248 permits continued rotation of gear 260 without imposition of substantial drag upon the rotation of gear 260 and without substantial noise.

Although disengagement mechanism 246 and 248 are illustrated as being substantially identical to one another, in other embodiments, disengagement mechanisms 246 and 248 may alternatively be different from one another. In other embodiments, one or both of disengagement mechanisms 244, 246 may have other configurations. For example, in other embodiments, one or both of disengagement mechanisms 246 and 248 may comprise a one-way clutch. Examples of one-way clutches include, but are not limited to, a ratchet-type one-way clutch, a frictional one-way clutch or a check-ball one-way clutch.

Although lift mechanism 230 is illustrated as including a disengagement mechanism on each end of rack gear 244, in other embodiments, one or both of disengagement mechanisms 246 and 248 may be omitted. For example, in one embodiment, disengagement mechanism 248 may be omitted, wherein additional sensors may be provided to identify when rack 243 is reached its travel limit and wherein controller 31 would generate control signals directing torque source 28 to cease transmission of torque to gear 260. In another embodiment, disengagement mechanism 246 may also or alternatively be omitted, wherein a pinion gear distinct from gear 260 is utilized to move rack 243, wherein sensors are provided to identify when rack 243 has reached its travel limit, and wherein controller 31 would generate control signals causing the supply of torque to the distinct pinion gear to be terminated in response to signals from the sensors.

In the example illustrated, drive support 222, arm 224, media drive member 226, gear train 304, gear train 310 and lift mechanism 230 function as a single drive unit 370 for driving media drive member 226 and for raising or lowering media drive member 226 using torque received via shaft 302. In other embodiments, additional drive units may be mounted to shaft 302. To accommodate even greater number of drive units 370, the length of shaft 302 may be increased. Because such drive units are light weight, space efficient and energy-efficient, such additional drive units 370 may be added without substantially increasing the cost, size or power demands on torque source 28.

As shown by FIG. 5, media stop mechanism 231 comprises one or more structures configured to be selectively positioned across a media path so as to abut media. Media stop mechanism 231 is movable between a first position (shown in FIG. 5) in which media stop mechanism 231 is withdrawn from the path and a second position (shown in FIG. 13) in which media stop mechanism 231 extends across a media path. In the particular example illustrated, media stop mechanism 231 is pivotally coupled to a frame or platen (not shown) and pivots between the first position and the second position. In the example illustrated, media stop mechanism 231 moves between the first position and the second position automatically in response to movement of media drive member 226 between a media driving and engaging position (shown in FIG. 5) and the media disengaged position (shown in FIG. 13).

In the example illustrated in which media drive system 220 is part of a media pick system, media stop mechanism 231 has a media load stop surface 340 supported by a linkage 241 and configured to offset sheets of media in a stack to facilitate their separation and picking. In the example illustrated, media load stop surface 340 includes a series of serrations or teeth. In other embodiments, media load stop surface 340 may include high friction surfaces or have other configurations.

Media stop lift 320 is part of lift mechanism 230. Media stop lift 320 moves media stop mechanism 231 between its first and second positions. In the example illustrated, media stop lift 320 includes cam 344 and cam follower 346 (shown in FIG. 4). Cam 344 comprises a slot or channel formed in rack 243 in which cam follower 346 slides and pivots. Cam follower comprises a pin extending from linkage 341 through the slot of cam 344 into connection with a structure (not shown) that is pivotably supported by a frame or platen (not shown).

In the particular example illustrated, cam 344 includes plateaus 347, 348 and ramp surface 350. Plateaus 347, 348 comprise relatively flat or linear slots extending substantially parallel to the linear direction in which rack 243 moves. Plateaus 347, 348 define the lower and raised end positions, respectively, of media stop mechanism 231 such that further linear movement of rack 243 does not result in further movement of media stop mechanism 231 when cam follower 346 is being guided by plateaus 347, 348. Ramp surface 350 is that portion of cam 344 which causes movement of media stop mechanism 231 between the first lowered position and the second raised position.

Although cam 344 is illustrated as engaging cam follower 346 to linearly move media stop mechanism 231, in other embodiments, cam 344 may have other configurations. For example, ramp surface 350 may be arcuate. Cam 344 may also have additional intermediate stages or positions. In other embodiments cam follower 346 may also have other configurations.

Because cam 344 and cam follower 346 cooperate to automatically raise or lower media stop mechanism 231 in response to movement of arm 224 between the media engaged state and a media disengaged state, additional sensors may be omitted, reducing the complexity of media drive system 220. Because movement of media stop mechanism 231 utilizes the linear translation of rack 243 relative to support 222 to move media stop mechanism 231, additional power sources and power trains may be omitted, further reducing complexity and cost. In other embodiments, media stop mechanism 231 may be actuated by other mechanisms or maybe omitted.

FIGS. 4-13 further illustrate operation of lift mechanism 130 in more detail. FIGS. 4-9 illustrate arm 224 and media drive member 226 in a lowered, media driving and media engaging state. In this state, controller 31 (shown in FIG. 4), following instructions contained on a computer-readable medium, is generating or has generated control signals causing torque source 28 to rotationally drive power train 229 in a first direction such that gear 260 (shown in FIG. 7) is rotationally driven in a clockwise direction. As a result, lost motion element 326 is slid within slot 322 and out of engagement with catch 324. Lost motion element 326 is free to rotate within slot 322 with reduced friction and with insubstantial noise. Rotation of shaft 302 in a direction so as to rotate gear 260 in the clockwise direction (as seen in FIG. 7) also results in media drive member 226 also rotating in a counter-clockwise direction such that any engaged media will be driven to the right as seen in FIG. 7. As seen in FIG. 5, when media drive member 226 is lowered to the media engaging state, media stop mechanism 231 is lowered and withdrawn from the media path, permitting driven media to be moved past media stop mechanism 231.

Figure 9:
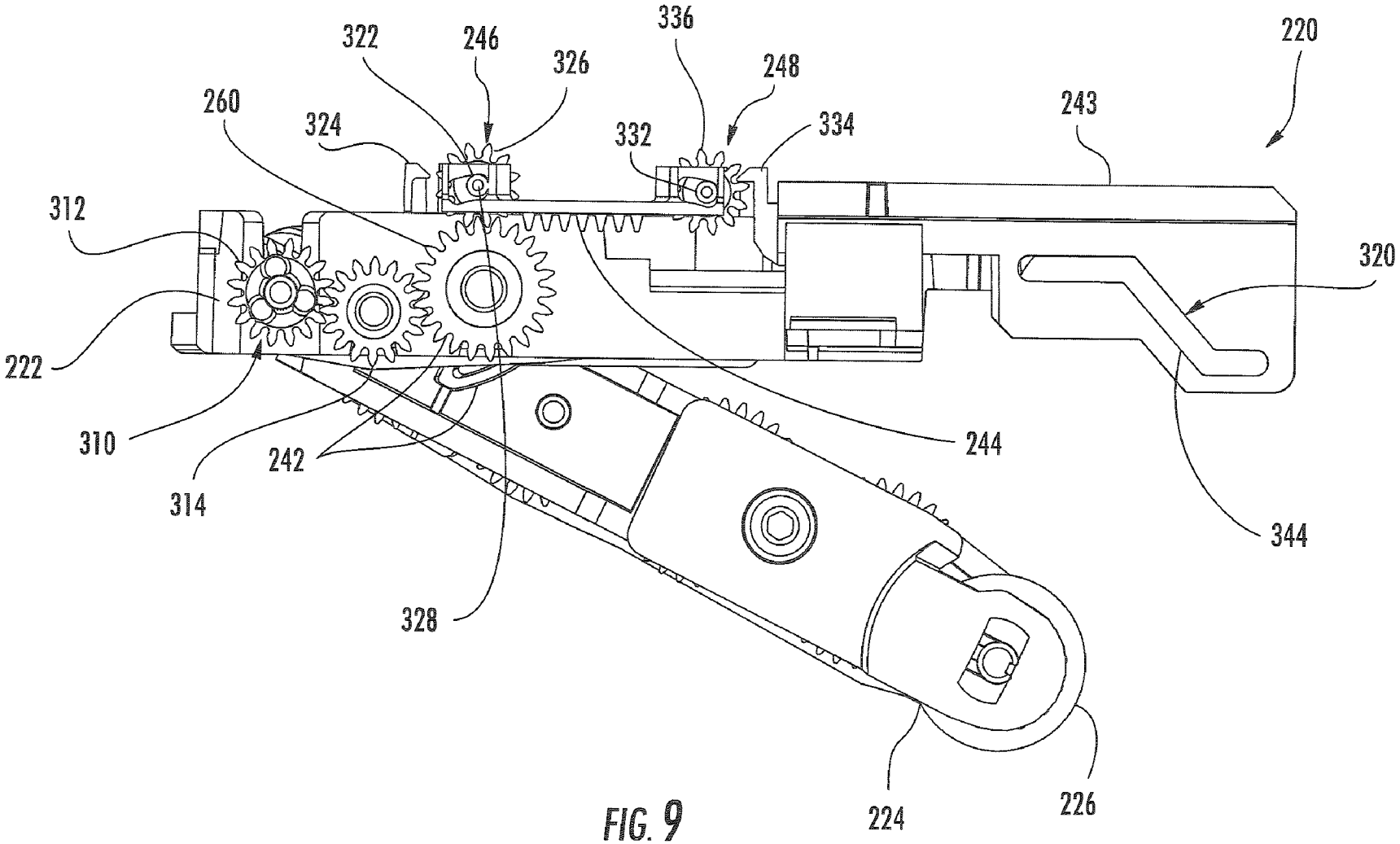
FIG. 9 is a sectional view of the media drive system of FIG. 4 taken along line 7-7 in FIG. 6 illustrating initial activation of a lift mechanism according to an example embodiment.

FIGS. 8 and 9 illustrate initial activation of lift mechanism 230 resulting in movement of rack 243 by disengagement mechanism 246 such that gear 260 ready for engagement with rack gear 244. In particular, controller 31 (shown in FIG. 4) generates control signals directing torque source 28 to supply torque in a second opposite direction. As a result, gear 260 is rotationally driven in a counter-clockwise direction (as seen in FIG. 9), sliding and rotating axle 328 of lost motion element 326 within slot 322 until lost motion element 326 is caught by catch 324. Because lost motion element 326 can no longer rotate, force imposed against lost motion element 326 by the continued rotation of gear 260 drives rack 243 in a leftward direction as seen in FIG. 9 until rack gear 244 is moved into engagement with gear 260.

Once in engagement with rack gear 244, gear 260 will rotate and drive rack 243 further to the left as seen in FIG. 9, causing cam 240 (shown in FIG. 8) to be driven to the right and to engage cam follower 242 to pivot arm and 242 and media drive member 226 in an upward direction towards the media disengaged state. In addition, as rack 243 is driven to the right in FIG. 8, cam 344 will be moved to the right, causing cam follower 346 to slide from the upper plateau 347 down ramp surface 350 to lower plateau 348. In other words, as arm 224 and media drive member 226 are moved towards the media disengaged position, media stop mechanism 231 is pivoted towards the raised media blocking position as seen in FIG. 13.

Figure 10:
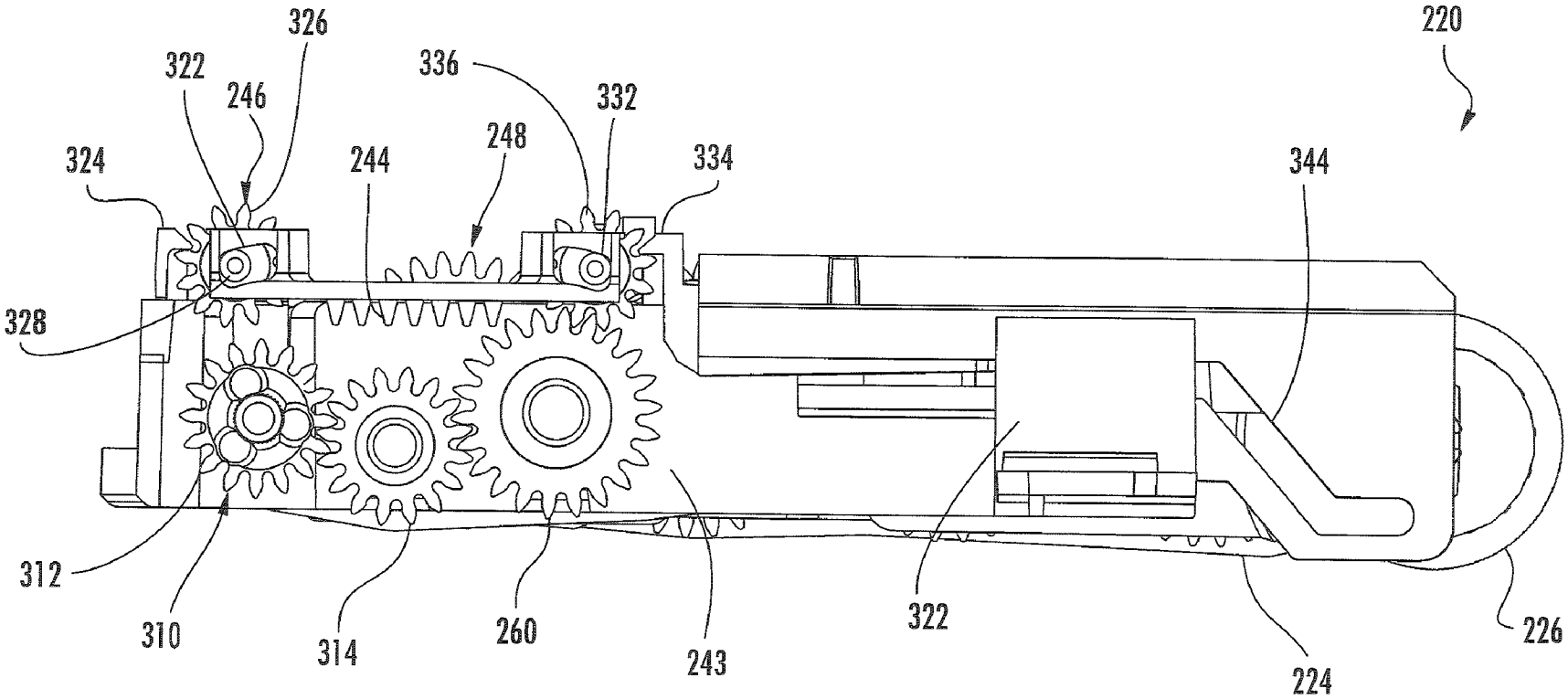
FIG. 10 is a sectional view of the media drive system of FIG. 4 taken along line 7-7 in FIG. 6 in a media disengaged state according to an example embodiment.
Figure 11:
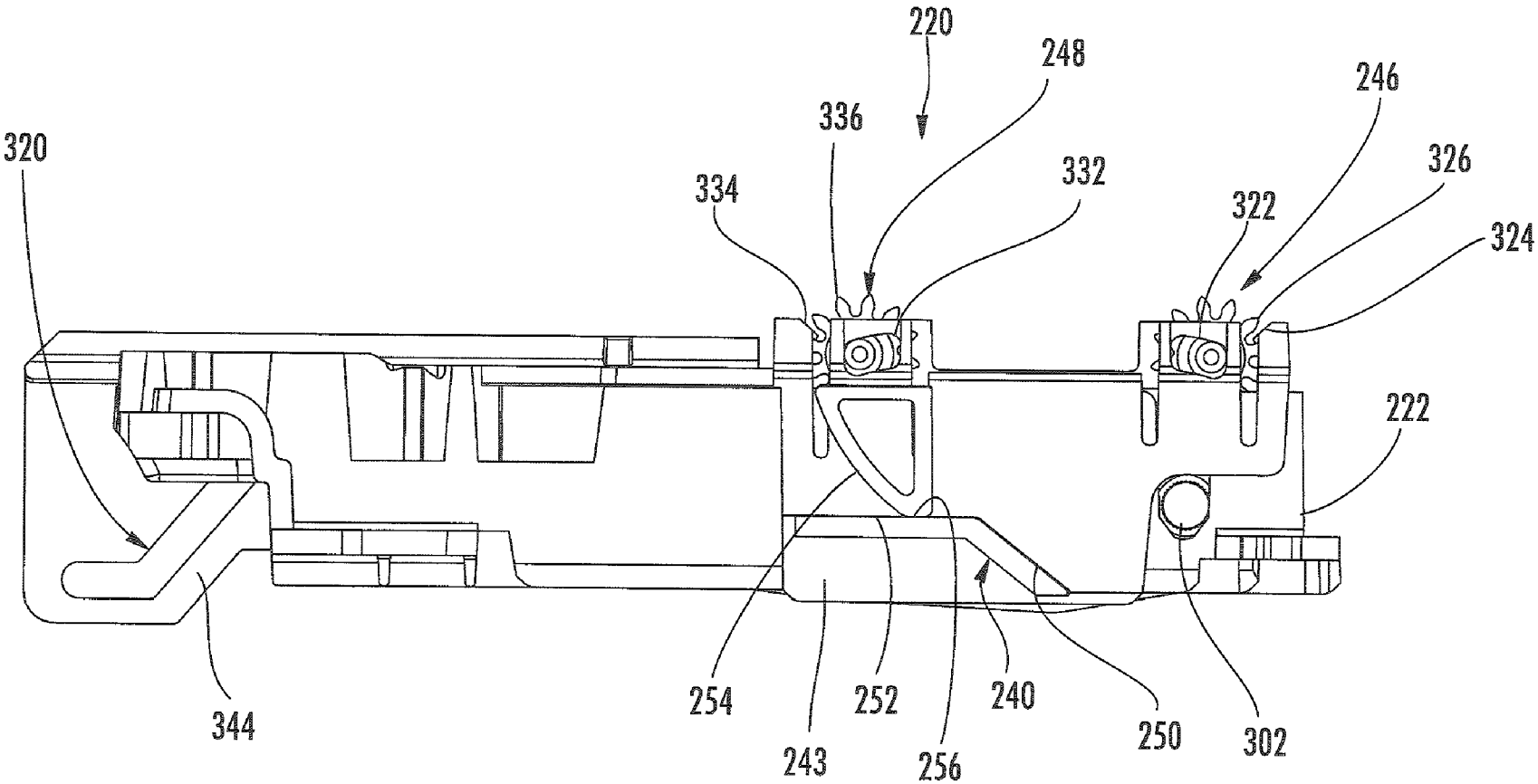
FIG. 11 is a sectional view of the media drive system of FIG. 12 taken along line 11-11 of FIG. 12 illustrating initial activation of the lift mechanism according to an example embodiment.

FIG. 10 illustrates arm 224 and media drive 226 in a fully raised, media disengaged state. As shown in FIG. 11, when in the fully raised state, cam follower 242 rests upon plateau 252 of cam 240. As shown in FIG. 10, rotation of gear 260 in the counter-clockwise direction as seen in FIG. 10 is continued. As a result, gear 260 engages lost motion element 336 and drives axle 338 of lost motion element 336 within slot 332 to the left and out of engagement with catch 334. Consequently, lost motion element 336 may freely rotate within slot 332, permitting gear 260 to continue to rotate without experiencing substantial drag or friction and without producing substantial noise.

Figure 12:
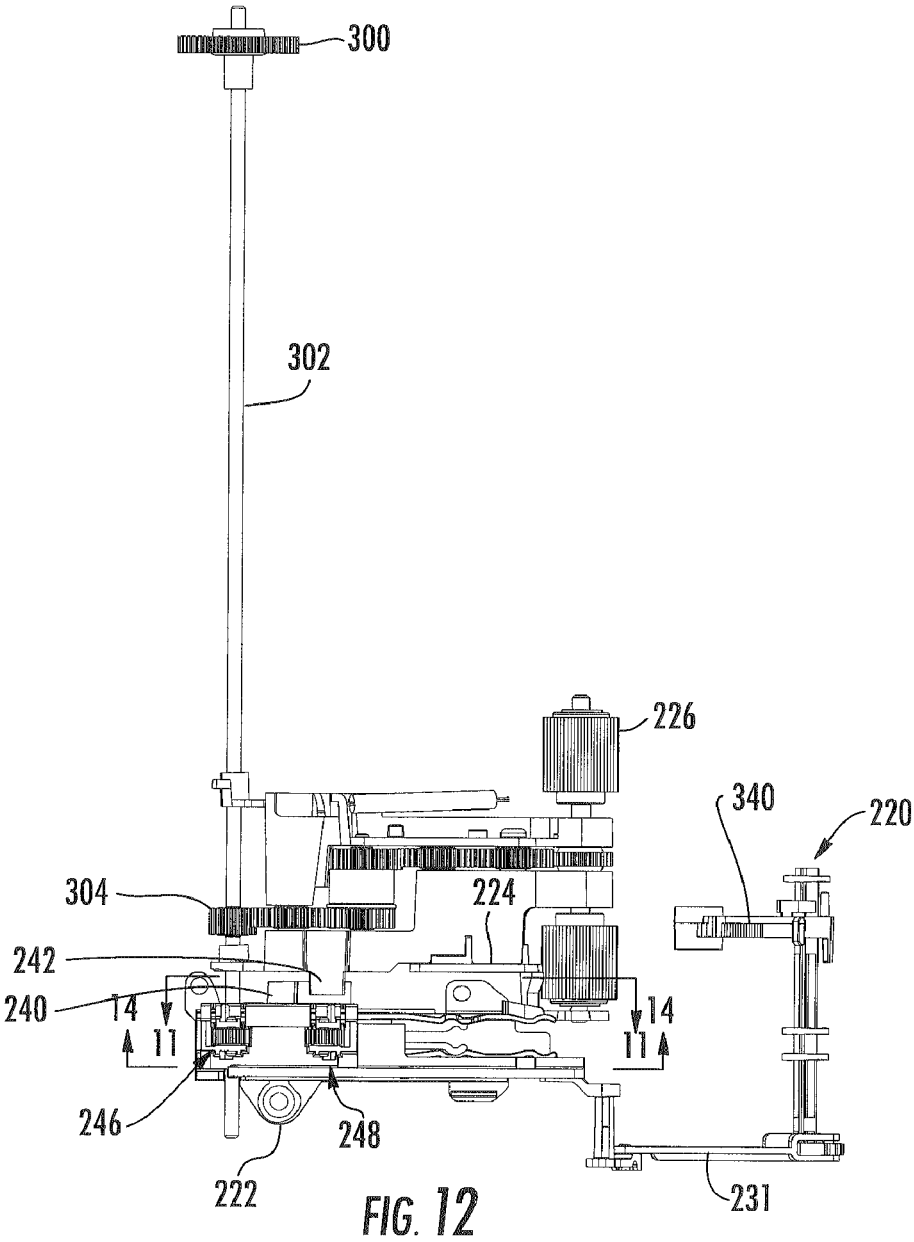
FIG. 12 is a top plan view of the media drive system of FIG. 11 according to an example embodiment.
Figure 13:
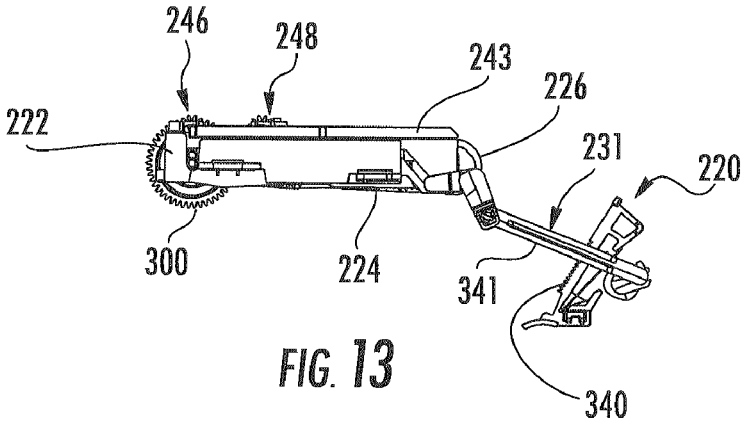
FIG. 13 is a side elevation of view of the media drive system of FIG. 12 according to an example embodiment.
Figure 14:
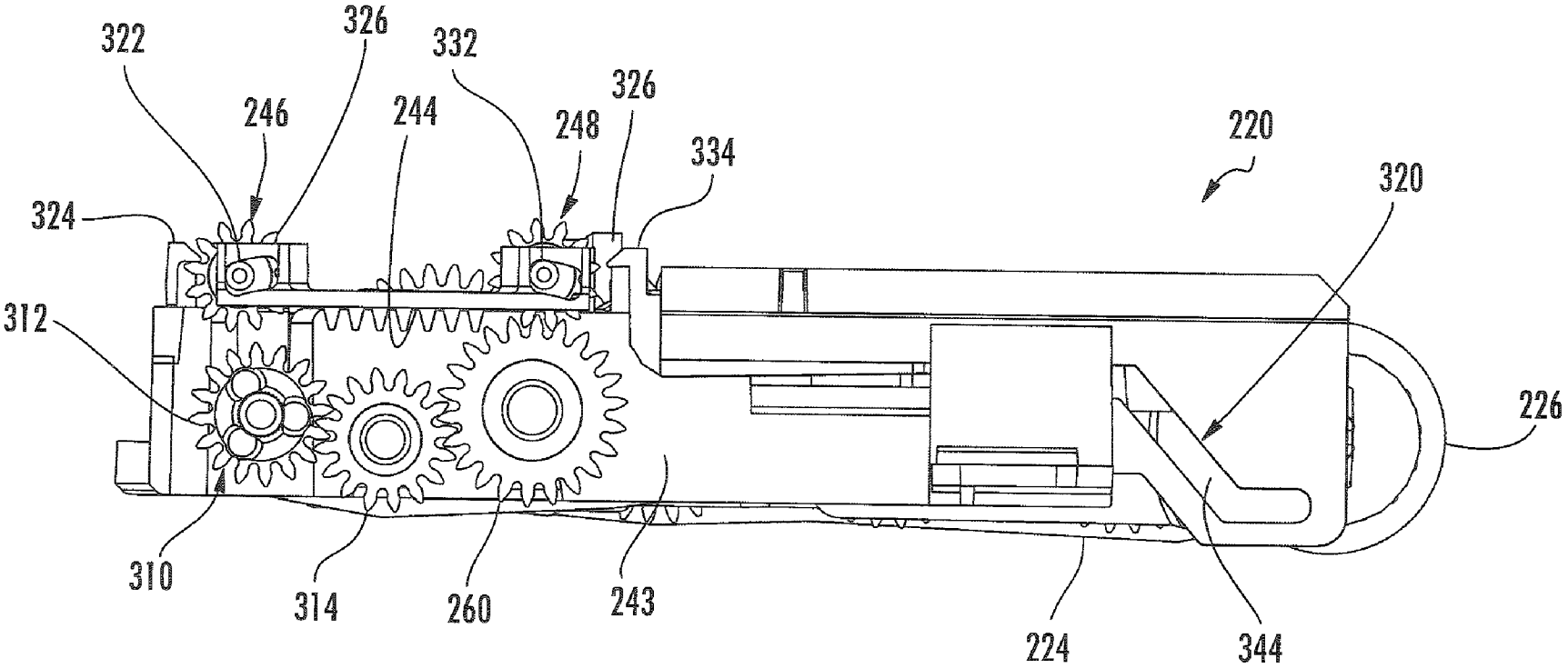
FIG. 14 is a sectional view of the media drive system of FIG. 12 taken along line 14-14 of FIG. 12 according to an example embodiment.

FIGS. 12-14 illustrate initial activation of lift mechanism 230 resulting in movement of rack 243 by disengagement mechanism 248 such that gear 260 is ready for engagement with rack gear 244. In particular, controller 31 (shown in FIG. 4) generates control signals directing torque source 28 to supply torque once again in the first direction. As a result, gear 260 is rotationally driven in a clockwise direction (as seen in FIG. 14), sliding and rotating axle 338 of lost motion element 336 within slot 332 until lost motion element 336 is caught by catch 334. Because lost motion element 336 can no longer rotate, force exerted against lost motion element 336 by the continued rotation of gear 260 drives rack 243 in a rightward direction as seen in FIG. 14 until rack gear 244 is moved into engagement with gear 260.

Once in engagement with rack gear 244, gear 260 will rotate and drive rack gear 244 further to the right as seen in FIG. 14, causing cam 240 (shown in FIG. 11) to be driven to the left as seen in FIG. 11 such that cam follower 242 slides down ramp surface 250 to pivot arm 224 and media drive member 226 in a downward direction towards the media engaged state (shown in FIGS. 4-7). In addition, as rack 243 is driven to the left as seen in FIG. 11, cam 344 will be moved to the left, causing cam follower 346 to slide from the lower plateau 348, up ramp surface 350 to upper plateau 347. In other words, as arm 224 and media drive member 226 are moved towards the media engaged position, media stop mechanism 231 is pivoted towards the lowered or withdrawn position as seen in FIG. 5.

Figure 15:
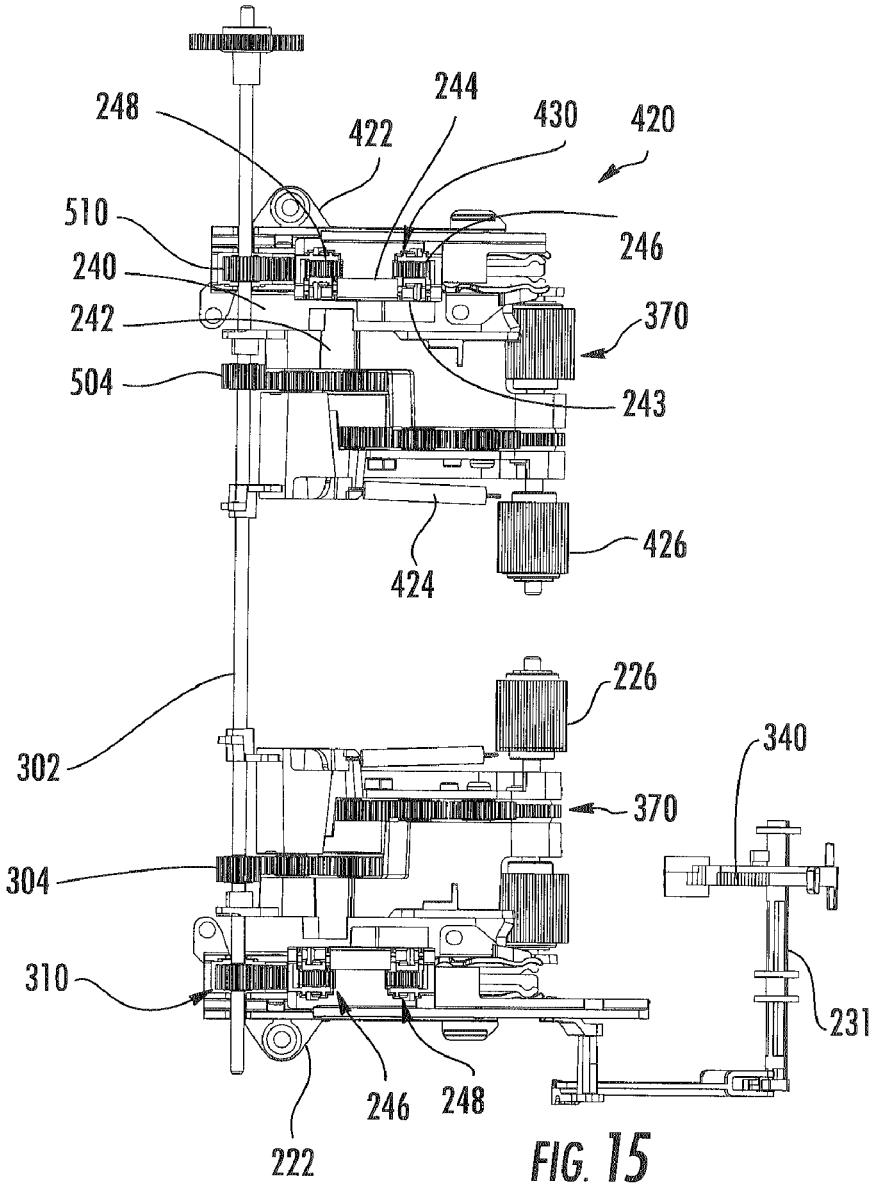
FIG. 15 is a top plan view of another embodiment of the media drive system of FIG. 1 according to an example embodiment.
Figure 16:
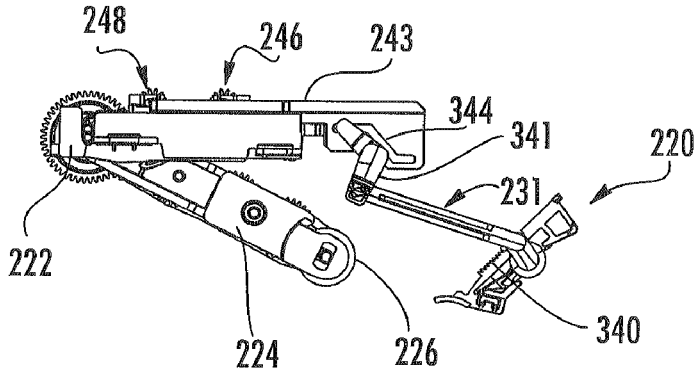
FIG. 16 is a side elevation of view of the media drive system of FIG. 15 on a according to an example embodiment.

FIG. 15 illustrates media drive system 420, another embodiment of media drive system 20. Media drive system 420 is similar to media drive system 220 except that media drive system 420 includes an additional drive unit 370 including drive support 422, arm 424, media drive member 426, gear train 504, gear train 510 and lift mechanism 430, each of which is substantially identical to drive support 222, arm 224, media drive member 226, gear train 304, gear train 310 and lift mechanism 230, respectively. In the example illustrated, lift mechanism 430 does not actuate an additional media stop mechanism 231. However, the other remaining functions of lift mechanism 230 are performed in identical fashions by lift mechanism 430. For example, gear trains 504 transmits torque from shaft 302 to rotationally drive media drive member 426. Gear train 510 terminates at a gear 260 (shown with respect to lift mechanism 230 in FIG. 7) which is in engagement with a rack gear substantially identical to rack gear 244 (shown in FIG. 7). As shown in FIG. 15, rack gear 244 is bordered on opposite sides by disengagement mechanisms 246 and 248 described above. Depending upon the direction in which torque is applied via shaft 302 from torque source 28 (shown in FIG. 4 in response to control signals from controller 31 (also shown in FIG. 4), media drive member 426 is moved between a media engaged state and a media disengaged state in a fashion similar to the movement of media drive member 226 between corresponding states. Because media drive system 420 includes multiple media drive members 426, media is more uniformly moved, potentially reducing skew. Because disengagement mechanisms 246 and 248 of lift mechanisms 230 and 430 permit media drive members 226 and 426 to continue to rotate without substantial friction or drag being imposed, such additional media drive members may be added without substantially increasing the size or capacity of torque source 28.

According to one embodiment, media drive system 420 is configured to complete movement of media drive members 226 and 426 to their respective media engaging states at different times offset from one another. As a result, the timing by which media drive members 226 and 426 are brought into engagement with a sheet of media may be tuned to reduce skew. For example, media drive members proximate a side of a sheet they brought into engagement with the sheet subsequent to media drive members located opposite a more central portion of the sheet. In one embodiment, rack 243 of lift mechanism 230 is initially positioned with respect to gear 260 of lift mechanism 230 at a location linearly offset from the initial positioning of rack 243 of lift mechanism 430 with respect to its associated gear 260. Consequently, as torque is provided to lift both mechanism 230 and lift mechanism 430 by shaft 302, media drive members to 226 and 426 will be actuated to their respective states at different times. In other embodiments, gear 260 or rack gear 244 of different lift mechanisms may provide different ratios such that the different lift mechanisms will raise and lower their respective media drive members at different speeds as the same torque is applied via shaft 302. Although media drive system 420 is illustrated as including two drive units, in other embodiments, media drive system 420 may be provided with additional drive units along shaft 302.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A media drive comprising:

a media drive member, wherein the media drive member comprises a media pick tire configured to extend opposite to a stack of sheets of media and to pick individual sheets from the stack;

a cam;

a cam follower, wherein one of the cam and the cam follower is coupled to the media drive member; and a linear actuation mechanism coupled to the other of the cam and the cam follower to linearly move the cam and the cam follower against one another to lift or lower the media drive member away from or towards media, wherein the linear actuation mechanism comprises:

a torque source;

a rack having a rack gear;

a pinion gear coupled to the torque source; and a first disengagement mechanism at a first end of the rack gear, the disengagement mechanism being configured to disengage the pinion gear from the rack gear in response to the pinion gear rotating in a first direction and to engage the pinion gear and the rack gear in response to the pinion gear rotating in a second direction.

2. The media drive of claim 1, wherein the pinion gear is part of a drive train transmitting torque to the media drive member to rotate the media drive member.

3. The media drive of claim 1, wherein the first disengagement mechanism comprises:

a slot and a catch coupled to the rack; and a gear having an axle rotatable and slidable within the slot between a catch engaged position and a catch disengaged position.

4. The media drive of claim 3, wherein the axle contacts the catch when in the catch engaged position and is out of contact with the catch when in the catch disengaged position.

5. The media drive of claim 3, wherein the axle contacts side edges of the slot.

6. The media drive of claim 1 further comprising a second disengagement mechanism at a second end of the rack gear opposite to the first end, the second disengagement mechanism being configured to disengage the pinion gear from the rack gear in response to the pinion gear rotating in the second direction and to engage the pinion gear and the rack gear in response to the pinion gear rotating in the first direction.

7. The media drive of claim 6, wherein the first disengagement mechanism comprises:

a first slot and a first catch coupled to the rack proximate the first end of the rack gear; and a first gear having a first axle rotatable and slidable within the first slot between a first catch engaged position and a first catch disengaged position and wherein the second disengagement mechanism comprises:

a second slot and a second catch coupled to the rack proximate the second opposite end of the rack gear; and a second gear having a second axle rotatable and slidable within the second slot between a second catch engaged position and a second catch disengaged position.

8. The media drive of claim 7, wherein the rotation of the pinion gear in the first direction moves the first gear from the first catch engaged position to the first catch disengaged position and wherein rotation of the pinion gear in the second direction opposite the first direction moves the second gear from the second catch engaged position to the second catch disengaged position.

9. The media drive of claim 1 further comprising:

a media load stop surface movable between a first position across a media path and a second position withdrawn from the path;

a second cam coupled to one of the rack and the media load stop surface; and a second cam follower in engagement with the second cam and coupled to the other of the rack and the media load stop surface, wherein the media load stop surface moves in response to movement of the rack.

10. The media drive of claim 9, wherein the media load stop surface is configured to contact edges of a stack of media when in the first position.

11. The media drive of claim 1, wherein the pinion gear and the rack gear contact one another when in engagement and wherein the pinion gear and the rack gear are out of contact with one another when disengaged.

12. The media drive of claim 1, wherein the pick tire is configured to contact a topmost sheet resting upon an underlying sheet.

13. A media drive comprising: a media drive member, wherein the media drive member comprises a media pick tire configured to extend opposite to a stack of sheets of media and to pick individual sheets from the stack; a cam; a cam follower, wherein one of the cam and the cam follower is coupled to the media drive member; and a linear actuation mechanism coupled to the other of the cam and the cam follower to linearly move the cam and the cam follower against one another to lift or lower the media drive member away from or towards media, wherein the linear actuation mechanism comprises:

a rack having a rack gear coupled to the other of the cam and the cam follower; and a pinion gear in engagement with the rack gear; and a lost motion element at an end of the rack gear, the lost motion element movable between a substantially freely rotating state and a locked state.

14. The media drive of claim 13 further comprising a torque source operably coupled to the pinion gear to rotationally drive the pinion gear and to rotationally drive the pick tire.

15. The media drive of claim 13 further comprising:

a first slot and a first catch proximate a first end of the rack gear; and a second slot and a second catch proximate a second end of the rack gear, and wherein the lost motion element comprises:

a first gear engageable by the pinion gear and having having an axle rotatable and slidable within the first slot between a first catch engaged position in which the axle contacts the first catch and a first catch disengaged position in which the axle is out of contact with the first catch.

16. A media drive comprising:

a media drive member;

a cam;

a cam follower, wherein one of the cam and the cam follower is coupled to the media drive member; and a linear actuation mechanism coupled to the other of the cam and the cam follower to move the cam and the cam follower against one another to lift or lower the media drive member away from or towards media, wherein the linear actuation mechanism comprises:

a torque source;

a rack having a rack gear;

a pinion gear coupled to the torque source; and a first disengagement mechanism at a first end of the rack gear, the disengagement mechanism being configured to disengage the pinion gear from the rack gear in response to the pinion gear rotating in a first direction and to engage the pinion gear and the rack gear in response to the pinion gear rotating in a second direction, wherein the first disengagement mechanism comprises:

a slot and a catch coupled to the rack; and a gear having an axle rotatable and slidable within the slot between a catch engaged position and a catch disengaged position.

17. The media drive of claim 16, wherein the axle contacts the catch when in the catch engaged position and is out of contact with the catch when in the catch disengaged position.

18. A media drive comprising:

a media drive member;

a cam;

a cam follower, wherein one of the cam and the cam follower is coupled to the media drive member; and a linear actuation mechanism coupled to the other of the cam and the cam follower to move the cam and the cam follower against one another to lift or lower the media drive member away from or towards media, wherein the linear actuation mechanism comprises:

a torque source;

a rack having a rack gear;

a pinion gear coupled to the torque source;

a first disengagement mechanism at a first end of the rack gear, the disengagement mechanism being configured to disengage the pinion gear from the rack gear in response to the pinion gear rotating in a first direction and to engage the pinion gear and the rack gear in response to the pinion gear rotating in a second direction;

a second disengagement mechanism at a second end of the rack gear opposite to the first end, the second disengagement mechanism being configured to disengage the pinion gear from the rack gear in response to the pinion gear rotating in the second direction and to engage the pinion gear and the rack gear in response to the pinion gear rotating in the first direction;

wherein the first disengagement mechanism comprises:

a first slot and a first catch coupled to the rack proximate the first end of the rack gear; and a first gear having a first axle rotatable and slidable within the first slot between a first catch engaged position and a first catch disengaged position; and wherein the second disengagement mechanism comprises:

a second slot and a second catch coupled to the rack proximate the second opposite end of the rack gear; and a second gear having a second axle rotatable and slidable within the second slot between a second catch engaged position and a second catch disengaged position.

* * * * *

UNITED STATES PATENT AND TRADEMARK OFFICE

CERTIFICATE OF CORRECTION

PATENT NO. : 7,926,803 B2
APPLICATION NO. : 11/669277
DATED : April 19, 2011
INVENTOR(S) : Raymond C. Sherman et al.

It is certified that error appears in the above-identified patent and that said Letters Patent is hereby corrected as shown below:

In column 16, lines 54-55, in Claim 15, delete “having having” and insert -- having --, therefor.

Signed and Sealed this
Twenty-third Day of August, 2011

David J. Kappos

David J. Kappos
*Director of the United States Patent and Trademark Office*